United States Patent [19]

Bosch

[11] 4,441,707

[45] Apr. 10, 1984

[54] ISOMETRIC EXERCISER BELT FOR JOGGERS AND THE LIKE

[76] Inventor: Jack L. Bosch, 2451 Wisconsin, North Muskegon, Mich. 49445

[21] Appl. No.: 283,612

[22] Filed: Jul. 15, 1981

[51] Int. Cl.[3] ..... A63B 21/12

[52] U.S. Cl. ..... 272/119; 272/67; 272/125; 272/126; 272/902

[58] Field of Search ..... 272/125, 67, 126, 70, 272/143, 93, DIG. 9, 116, 68, 119, 139, 142; 273/55 B, DIG. 19

[56] References Cited

U.S. PATENT DOCUMENTS

| | | | |
|---|---|---|---|
| 866,495 | 9/1907 | Marks | 272/139 |
| 1,402,179 | 1/1922 | Piscitelli | 272/139 |
| 2,035,010 | 3/1936 | Rawlings | 272/142 |
| 3,197,204 | 7/1965 | Holkesvick et al. . | |
| 3,204,955 | 9/1965 | Quire et al. . | |
| 3,374,636 | 3/1968 | Mason . | |
| 3,462,142 | 8/1969 | Sterndale . | |
| 3,532,339 | 10/1970 | Smith | 272/119 |
| 3,583,394 | 6/1971 | Napoli | 272/68 X |
| 3,608,900 | 9/1971 | Welch . | |
| 3,659,843 | 5/1972 | Kojigian, Jr. . | |
| 3,999,752 | 12/1976 | Kupperman et al. | 272/126 |
| 4,019,734 | 4/1977 | Lee et al. . | |
| 4,071,241 | 1/1978 | Garcia . | |
| 4,121,822 | 10/1978 | DiSabatino et al. . | |
| 4,251,070 | 1/1931 | Leseberg | 272/68 X |
| 4,335,875 | 6/1982 | Elkin | 272/126 X |
| 4,337,938 | 7/1982 | Rodriguez | 272/70 X |

*Primary Examiner*—Richard J. Apley
*Assistant Examiner*—William R. Browne
*Attorney, Agent, or Firm*—Price, Heneveld, Huizenga & Cooper

[57] ABSTRACT

An exerciser which includes a belt shaped for encircling the waist of a user, and attachment thereabout in a selected orientation. A flexible line with handles attached to opposite ends is slidingly connected with the belt for longitudinal, reciprocating motion of the flexible line with respect to the belt. While jogging, the user can simultaneously exercise his upper body muscles by grasping the handles in opposite hands, and alternately pushing one handle forwardly, while simultaneously resisting rearward movement of the other handle, thereby isometrically exercising the user's arm and upper body muscles.

26 Claims, 6 Drawing Figures

ISOMETRIC EXERCISER BELT FOR JOGGERS AND THE LIKE

BACKGROUND OF THE INVENTION

The present invention relates to exercisers, and in particular to an isometric exercise device for joggers and the like.

Walking, jogging, long distance running, and other similar exercises have become increasingly popular, and are generally believed to improve the participant's cardiovascular system, body tone, and general state of health. Although such exercises are typically considered quite beneficial in developing lower body muscles, particularly the legs, they are not generally useful for toning the upper body muscles, such as those located in the arms, shoulders, back, chest, etc. Separate weight lifting exercises are usually required to establish a complete exercise program.

Since walking and jogging are rather time consuming activities, it is very difficult for most working individuals to simultaneously maintain a supplemental exercise program for the upper body. This situation is particularly exacerbated when special facilities, such as weight lifting machines, and other exercise equipment are required.

SUMMARY OF THE INVENTION

One aspect of the present invention is to provide an isometric exerciser which is particularly adapted for use by walkers, joggers and the like, and comprises a belt shaped for encircling the waist of the user, with means for selectively retaining the same thereabout in a selected orientation. A flexible line with handles attached to both ends thereof is slidingly connected with the belt for longitudinal, reciprocating motion, whereby during operation, the user grasps the handles in opposite hands, and alternately pushes one hand forwardly, while simultaneously resisting rearward movement of the other handle, thereby isometrically exercising the user's arm and upper body muscles, preferably while simultaneously conducting running-type exercises which develop the lower body muscles to establish a complete exercise program.

The principal objects of the present invention are to provide a device for exercising the upper body muscles, which can be carried by a jogger or the like, and used while performing running-type exercises to establish a more complete exercise program. The exerciser is preferably of an isometric type, wherein resistance to the reciprocal motion of the flexible line is achieved by the force of the user himself, thereby providing a very lightweight, inexpensive, and uncomplicated construction. The handles of the exerciser are preferably resiliently compressible, so that they can be squeezed as the flexible line is reciprocated for simultaneously exercising hand, wrist, arm, and upper body muscles. At least one of the handles is preferably detachably connected to the flexible line, so that the exerciser can be adjusted to accommodate different users. The flexible line is preferably attached to the belt by a flexible tube, constructed of a self-lubricating, synthetic resin material, which is quite uncomplicated, durable, efficient in use, and provides a long operating life.

These and other features, advantages and objects of the present invention will be further understood and appreciated by those skilled in the art by reference to the following written specification, claims, and appended drawings.

DETAILED DESCRIPTION OF THE PREFERRED EMBODIMENTS

Figure 1:
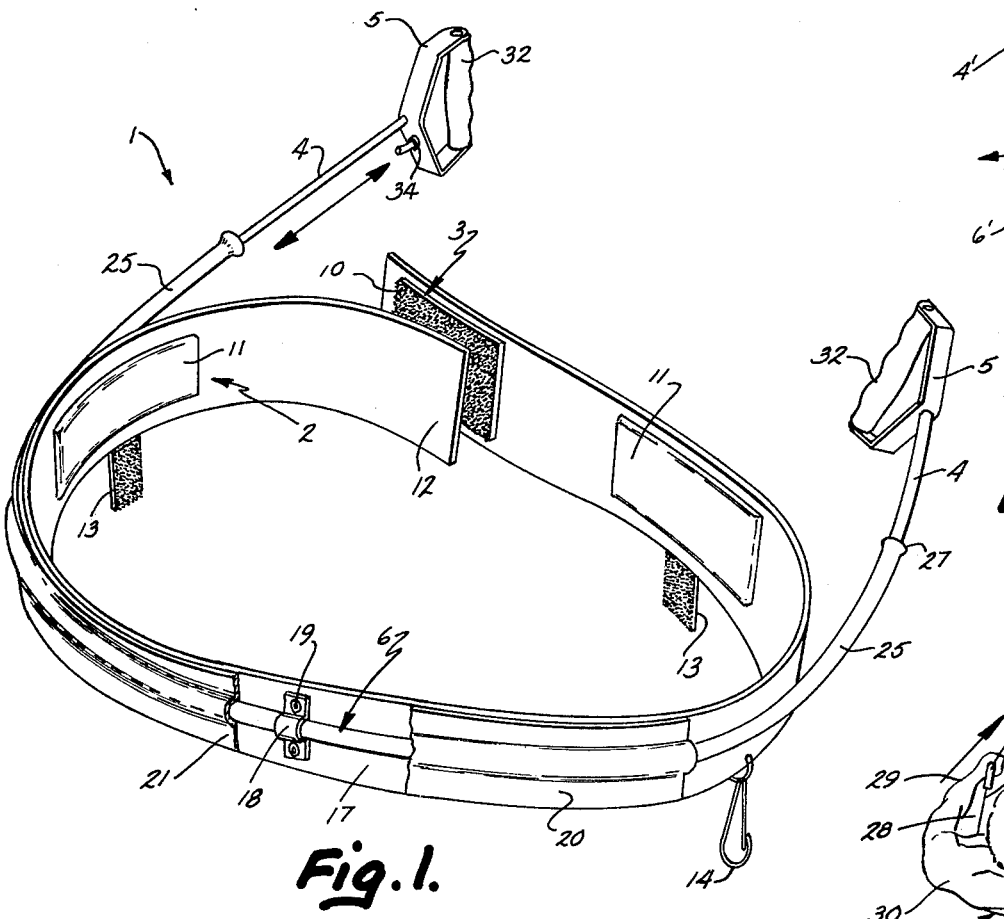
FIG. 1 is a perspective view of an isometric exerciser embodying the present invention, with a portion thereof broken away to reveal internal construction.
Figure 3:
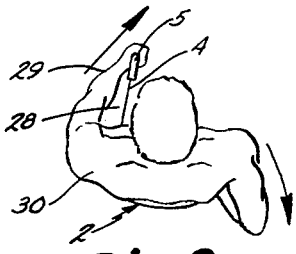
FIG. 3 is a partially schematic, top plan view of the exerciser shown attached to a user.

For purposes of description herein, the terms "upper", "lower", "right", "left", "rear", "front", "vertical", "horizontal", and derivatives thereof shall relate to the invention as oriented in FIGS. 1 and 3. However, it is to be understood that the invention may assume various alternative orientations, except where expressly specified to the contrary.

The reference numeral 1 (FIG. 1) generally designates an isometric exerciser embodying the present invention, comprising a belt 2 shaped for encircling the waist of a user, with a latch 3 to retain the same constrictingly thereabout in a selected orientation. A flexible line 4 with handles 5 attached to opposite ends thereof is slidingly connected with belt 2 by a tube 6 for longitudinal, reciprocating motion of flexible line 4 with respect to belt 2. When the user is performing running-type exercises, such as jogging or long distance running, the upper body muscles can be exercised by grasping handles 5 in opposite hands, and alternately pushing one handle forwardly, while simultaneously resisting rearward movement of the other handle, thereby isometrically exercising the upper body muscles.

Belt 2 is preferably flexible, and slightly elastic to facilitate constrictingly attaching the same about the waist of the user. In this example, belt 2 is constructed from an elongate strip of woven nylon webbing, preferably having a rather wide width, in the nature of 3–6 inches to stabilize the internal organs of the jogger, particularly the kidneys. Latch 3 comprises mating strips of hook and loop fasteners 10 attached to opposite ends of belt 2 on overlying sides thereof. At least one of the fastener strips 10 preferably extends longitudinally along the belt for some distance, so as to provide means for adjusting the exerciser to fit various individuals. A conventional shoulder strap (not shown) can also be attached to belt 2 if required to hold the belt in place. The illustrated belt 2 includes a plurality of pouches or pockets 11 formed in the interior surface 12 whereof, which are shaped to receive weights (not shown) therein for strengthening the jogger's leg muscles and developing extra stamina. Pockets 11 can also be used to retain medication, money, and/or other relatively small objects which the wearer desires to carry with him. Also the illustrated belt 2 includes a pair of hook and loop fastener strips 13 attached to and depending from the forward side of belt 2 for storing handles 5 when not in use, as described in greater detail hereinafter. Belt 2 may also include additional clips 14 attached to and depending from belt 2 for carrying various jogging accessories, such as a water-container, a radio, Mace, or the like.

Connecting tube 6 is preferably attached to the exterior side 17 of belt 2 along the longitudinal centerline thereof by suitable fasteners. In this example, connector tube 6 is attached to belt 2 by a U-shaped bracket 18 mounted thereon by rivets 19, as well as sheaths 20 which are formed around the exterior of tube 6 and stitched to belt 2. The tube fasteners 18 and 20 are spaced around the entire rear side of belt 2 to conform tube 6 to belt 2, and interconnect the same along an arcuate measure in the nature of 180 degrees. Fasteners 18 and 20 fixedly attach tube 6 to belt 2 to prevent relative motion therebetween, even when flexible line 4 is reciprocated. A padded nylon cover 21 extends over the exterior surface 17 of belt 2, and covers that portion of tube 6 overlying belt 2, as well as fasteners 18 and 20 to provide the exerciser 1 with a neat, finished appearance. Preferably, the exterior surface of cover 21 is light reflective for safety when jogging in non-daylight hours.

Figure 2:
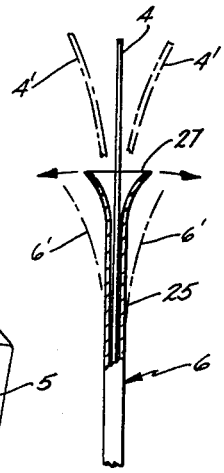
FIG. 2 is a fragmentary, side elevational view of a mounting tube for attaching a flexible line to a belt portion of the exerciser, with the end portion broken away to reveal the interior of the tube.

Tube 6 is constructed of a resiliently flexible, self-lubricating material, such as a synthetic resin in the nature of polyvinylchloride. Tube 6 has an inside diameter slightly larger than the outside diameter of flexible line 4, such that line 4 will freely glide or slide in tube 6 when reciprocated. The free ends 25 of tube 6 project generally tangentially from opposide sides of the belt to a location adjacent handles 5. Since the tube free ends 25 are resiliently flexible, they are permitted to bend freely at the belt, as shown by the imaginary lines 6' in FIG. 2, so as to follow the direction in which the corresponding flexible line end is extended, and thereby alleviate binding of line 4 in the tube. Also, the terminal ends 27 of tube 6 are flared outwardly in a trumpet configuration, which permits line 4 to be reciprocated in a slightly non-aligned relationship with the tube ends 25 as illustrated by the broken lines 4' in FIG. 2, without causing the line to become stuck or damage the end of tube 6.

Figure 4:
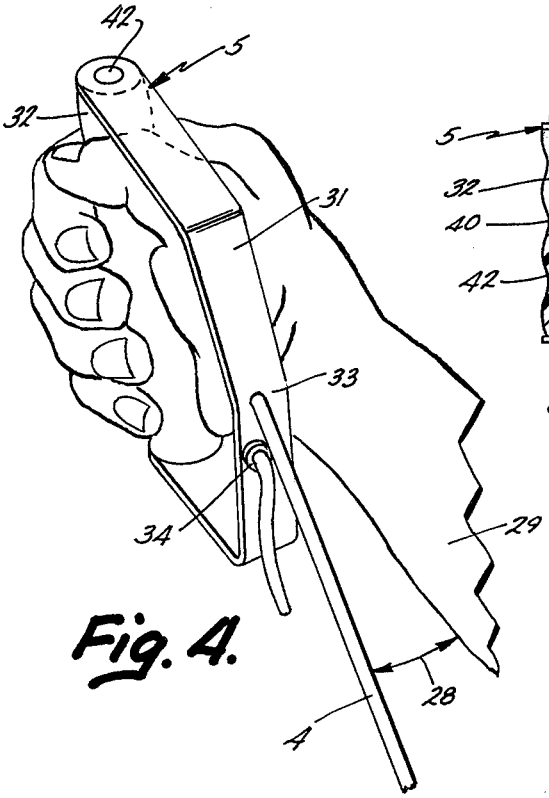
FIG. 4 is a fragmentary, enlarged, perspective view of a handle portion of the exerciser, shown being gripped by the hand of the user.
Figure 5:
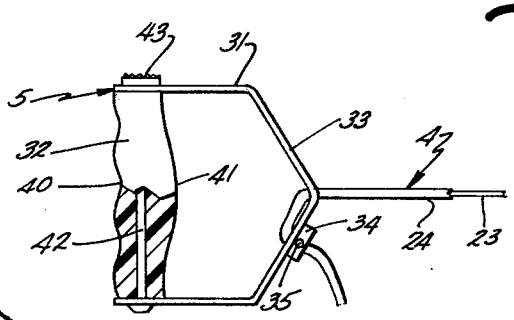
FIG. 5 is a side elevational view of the handle.

Flexible line 4 is preferably inelastic, and includes an interior, structural cord 23 (FIG. 5), and a self-lubricating exterior sleeve or coating 24 which permits it to glide smoothly through tube 6. In this example, line 4 comprises nylon coated aircraft cable, which is extremely strong, yet sufficiently flexible to permit handles 5 to be reciprocated without being too stiff or otherwise creating substantial internal resistance. The free ends 25 of tube 6 position the ends of line 4 and the handles 5 at the sides, and slightly forward of the wearer. Hence, when the exerciser 1 is used, and line 4 is thereby extended taut and reciprocated with a forwardly pumping action of the user's arms, as illustrated in FIGS. 3 and 4, there is a naturally formed gap or clearance 28 (FIG. 4) between the flexible line 4 and the forearms 29 of the user 30, which avoids contact and abrasion therebetween.

Handles 5 are securely attached to opposite ends of flexible line 4. Preferably, at least one of the handles 5 includes means for detachably connecting the same with flexible line 4, whereby the relative position of the two handles 5 can be adjusted to accommodate different users. In the example illustrated in FIGS. 1–5, handles 5 include a rigid, U-shaped frame 31 with a grip 32 mounted at the open, outer end thereof. An aperture extends through the base portion 33 of the handle frame 31, through which flexible line 4 extends for attachment to the handle 5. The non-adjustable handle (shown on the right hand side of the exerciser illustrated in FIG. 1) is attached to line 4 by any conventional means, such as a retainer, clip, or simply a knot on the interior side of handle frame 31. The adjustable handle (shown on the left hand side of the exerciser illustrated in FIG. 1) includes a second aperture through handle frame 31 adjacent the bottom of the base portion 33 thereof, through which the end of line 4 is threaded. A sleeve 34 with set screw 35 is threaded over the end of line 4, and securely attached thereto so that line 4 cannot be inadvertently pulled out of handle frame 31.

Grip 32 is preferably resiliently compressible, and shaped for squeezing the same as the flexible line is reciprocated for simultaneously exercising hand, arm and upper body muscles. In this example, grip 32 is of a molded, integral construction, and includes finger indentations 40 along the forward surface thereof, with a convex rear area 41 adapted for reception in the palm of the user's hand. A rigid pin 42 extends longitudinally through grip 32, and securely attaches the same to handle frame 31. A hook and loop fastener dot 43 (FIG. 5) is attached to one end of handle frame 31, and is adapted to mate with fastener strips 13 so that handles 5 can be attached directly to belt 2 when not in use, and will not drag or otherwise disrupt the user while conducting other exercises.

Figure 6:
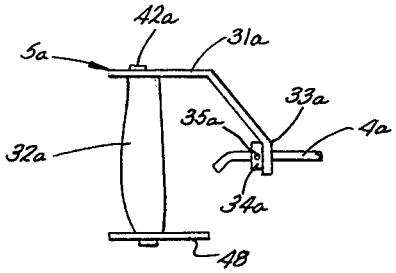
FIG. 6 is a side elevational view of another embodiment of the exerciser handle.

The reference numeral 5*a* (FIG. 6) designates another embodiment of the exerciser handle having a different attachment arrangement for flexible line 4*a*. Since handle 4*a* is otherwise similar to the previously described handle 4, similar parts appearing in FIGS. 1–5 and 6 respectively are represented by the same, corresponding reference numeral, except for the suffix "a" in the numerals of the latter. The frame 31*a* of handle 5*a* is attached to only one end of grip 32*a*, and has a generally L-shaped configuration. The base portion 33*a* of handle frame 31*a* has an aperture through which flexible line 4*a* extends, with sleeve 34*a* threaded over the terminal end of line 4*a*, and attached to the same by set screw 35*a* to adjustably secure the handle to the flexible line. Handle frame 31*a* is attached to the upper end of grip 32*a*, by pin 42*a*. A plate 48 is attached to the lower end of grip 32*a* by pin 42*a*, and assists the user in maintaining a secure grip on the handle.

During operation, the user grasps opposite ends of belt 2, and wraps the same about his waist. If the user wants to carry additional weight, appropriate weights are first inserted into pockets 11, along with any other items the jogger desires to take with him. The ends of belt 2 are manually converged until the belt constricts against and fits tight on the user's waist. The mating hook and loop fastener strips 10 are then interconnected to securely maintain the belt on the user in an operational orientation, wherein the free ends 25 of tube 6 point forwardly. The distance between handles 5 is then adjusted by manipulating sleeve 34, so that the user's arms can be alternately extended fully, without pulling the opposite arm so far back that strain would result.

Although exerciser 1 can be used in a wide variety of different ways, including as a stationary exerciser, it is particularly adapted to be used in conjunction with running-type exercises, especially walking, running in place, and/or jogging. After exerciser 1 has been strapped in place, the user may now perform these running-type exercises in a conventional fashion. The lightweight construction of exerciser 1 will not substantially inhibit the running exercises. Preferably, when exerciser 1 is not being used, handles 5 are attached to fastener strips 13, so that the handles are stored securely along the sides of the user.

When the user desires to exercise his upper body muscles, he simply detaches exercise handles 5 by pulling them off of fastener strips 13. The user grasps handles 5 in opposite hands, and begins exercising by alternatively pushing one handle forwardly, while simultaneously resisting rearward motion of the other handle, thereby isometrically exercising his arms and upper body muscles. Since the exerciser is of an isometric nature, the user himself controls the amount of resistance to the reciprocating motion, and can immediately change the degree of upper body exercise without breaking rhythm or stride, by simple increasing or reducing the force of resistance. Since the free ends of tube 6 are resiliently flexible, the user can force the handles outwardly in a direction which is not coaxial with the normal position of the tube ends to obtain variation in the exercise pattern. Tube ends 6 flex into alignment with line 4, and can do so in both the vertical and horizontal axes. Handles 5 are sequentially squeezed or compressed as line 4 is reciprocated, to further develop hand, wrist and forearm muscles.

The construction of isometric exerciser 1 is extremely uncomplicated so that it is inexpensive to manufacture, lightweight, and has a long operating life.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. An isometric exercise device for joggers and the like, comprising:

a belt shaped for encircling the waist of a jogger;

means for selectively retaining said belt securely about the waist of the jogger in a selected orientation;

a flexible line being substantially inelastic first and second handles connected to opposite ends of said flexible line;

means for slidingly receiving said flexible line generally along the longitudinal axis of said belt for longitudinal, reciprocating motion of said flexible line with respect to said belt; said receiving means including substantially rigid members that extend forwardly from positions that are generally in the direction of a user's arms when said arms are extended forwardly in front of a user to support said handles forwardly and between the arms of the user, and thereby keep said flexible line out of contact with the arms of the jogger during isometric exercising therewith;

means for detachably connecting said handles to said belt at opposite locations thereon which retains said handles and said attached flexible line in a storage position, out of contact with the legs of the jogger when the jogger is running, whereby during operation, the user detaches the handles from said belt, grasps said handles in opposite hands, and alternately pushes one handle forwardly, while simultaneously resisting rearward movement of the other handle, thereby isometrically exercising arm and upper body muscles at the same time as the lower body muscles of the jogger.

2. An exercise device as set forth in claim 1, wherein: said first and second handles are resiliently compressible, and shaped for squeezing the same as said flexible line is reciprocated for simultaneously exercising hand, arm and upper body muscles.

3. An exercise device as set forth in claim 2, wherein: said first and second handles each have a contoured body which is anatomically shaped to fit a human hand.

4. An exercise device as set forth in claim 3, wherein: at least one of said handles includes means for detachably connecting the same with said flexible line, whereby the relative position of said handles can be adjusted to accommodate different users.

5. An exercise device as set forth in claim 4, wherein: said flexible line receiving means comprises a flexible tube attached to said belt, and having an interior shaped for slidingly receiving said flexible line therethrough.

6. An exercise device as set forth in claim 5, wherein: said tube has free ends projecting generally tangentially from opposite sides of said belt to a location adjacent said handles; and said tube free ends are resiliently flexible to alleviate line binding.

7. An exercise device as set forth in claim 6, wherein: said tube free ends have outwardly flared terminal portions to further alleviate line binding.

8. An exercise device as set forth in claim 7, wherein: said tube is constructed from a self-lubricating, synthetic resin material.

9. An exercise device as set forth in claim 8, wherein: said flexible line includes a self-lubricating exterior sleeve for sliding contact with the interior of said tube.

10. An exercise device as set forth in claim 9, wherein:

said belt retaining means comprises means for detachably interconnecting opposite ends of said belt in a constricted condition about the waist of the user.

11. An exercise device as set forth in claim 10, wherein:

said belt interconnecting means comprises mating hook and loop fastener strips attached to opposite ends of said belt.

12. An exercise device as set forth in claim 11, wherein:

said belt includes pockets shaped for receiving weights therein.

13. An exercise device as set forth in claim 12, wherein:

said belt includes light reflective material on an exterior surface thereof for safety.

14. An exercise device as set forth in claim 1, wherein:

said first and second handles each having a contoured body which is anatomically shaped to fit a human hand.

15. An exercise device as set forth in claim 1, wherein:

at least one of said handles includes clamp means for detachably connecting the same with said flexible line, whereby the relative position of said handles can be adjusted to accommodate different users.

16. An exercise device as set forth in claim 1, wherein:

said flexible line receiving means comprises a flexible tube attached to said belt, and having an interior shaped for slidingly receiving said flexible line therethrough.

17. An exercise device as set forth in claim 16, wherein:

said receiving means ends are resiliently flexible to alleviate line binding.

18. An exercise device as set forth in claim 1, wherein:

said belt retaining means comprises means for detachably interconnecting opposite ends of said belt in a constricted condition about the waist of the user.

19. An exercise device as set forth in claim 1, wherein:

said receiving means ends have outwardly flared terminal portions to alleviate line binding.

20. An exercise device as set forth in claim 1, wherein:

said receiving means ends are constructed from a self-lubricating, synthetic resin material.

21. An exercise device as set forth in claim 1, wherein:

said flexible line includes a self-lubricating exterior sleeve for sliding contact with the interior of said connecting means.

22. An exercise device as set forth in claim 1, wherein:

said belt selective retaining means comprises mating hook and loop fastener strips attached to opposite ends of said belt.

23. An exercise device as set forth in claim 1, wherein:

said belt includes pockets shaped for receiving weights therein.

24. An exercise device as set forth in claim 1, wherein:

said belt includes light reflective material on an exterior surface thereof for safety.

25. An isometric exercise device, comprising:

a belt shaped for encircling the waist of a user;

means for selectively retaining said belt securely about the waist of the user in a selected orientation;

a flexible line;

first and second handles connected with opposite ends of said flexible line;

means for slidingly receiving said flexible line generally along the longitudinal axis of said belt for longitudinal, reciprocating motion of said flexible line with respect to said belt, whereby during operation, the user grasps said handles in opposite hands, and alternately pushes one handle forwardly, while simultaneously resisting rearward movement of the other handle, thereby isometrically exercising arm and upper body muscles; p1 said flexible line receiving means comprises a flexible tube attached to said belt, and having an interior shaped for slidingly receiving said flexible line therethrough;

said tube has free ends projecting generally tangentially from opposite sides of said belt to a location adjacent said handles; and said tube free ends are resiliently flexible to alleviate line binding.

26. An exercise device as set forth in claim 18, wherein:

said tube free ends have outwardly flared terminal portions to further alleviate line binding.

* * * * *

UNITED STATES PATENT AND TRADEMARK OFFICE

CERTIFICATE OF CORRECTION

PATENT NO. : 4,441,707

DATED : April 10, 1984

INVENTOR(S) : Jack L. Bosch

It is certified that error appears in the above-identified patent and that said Letters Patent is hereby corrected as shown below:

Column 5, claim 1, line 45:

After "inelastic" insert --;--

Column 8, claim 25, line 22:

Delete "pl"

Signed and Sealed this

*Sixth* Day of *November 1984*

[SEAL]

*Attest:*

GERALD J. MOSSINGHOFF

*Attesting Officer*

*Commissioner of Patents and Trademarks*